United States Patent [19]

Needham et al.

[11] Patent Number: 4,480,407

[45] Date of Patent: Nov. 6, 1984

[54] PET DOORS

[76] Inventors: Robert J. Needham, 12 Grosvenor Rd., Chiswick, London W.4; Philip T. Blenkinsop, 56 Chapel La., Fowlmere, Royston, Hartfordshire, both of England

[21] Appl. No.: 407,497

[22] Filed: Aug. 12, 1982

[30] Foreign Application Priority Data

Aug. 26, 1981 [GB] United Kingdom ..... 8125975

[51] Int. Cl.[3] ..... E06B 7/32

[52] U.S. Cl. ..... 49/168; 49/478; 49/480

[58] Field of Search ..... 49/168–171, 49/480, 481, 478; 292/251.5

[56] References Cited

U.S. PATENT DOCUMENTS 2,860,700 11/1958 Horton ..... 49/170 X 3,248,159 4/1966 Hall ..... 49/478 X 3,362,108 1/1968 Jones ..... 49/478

4,047,331 9/1977 Davlantes ..... 49/171

*Primary Examiner*—Kenneth Downey

*Attorney, Agent, or Firm*—Wellington M. Manning, Jr.; Luke J. Wilburn, Jr.

[57] ABSTRACT

A pet door comprises a frame hingedly supporting a flap undersized relative to the opening therefor in the frame; the resulting gaps therebetween are weather-proofed by sealing means in part constituted by co-extensive plastics magnet strips on confronting edges of the flap and frame. One magnet strip at least is mounted for movement in a direction across the gap into and out of face-to-face sealing contact with the other magnet strip, respectively as the flap enters and leaves its closed position; the movement is responsible for jam-free closing and opening.

19 Claims, 8 Drawing Figures

PET DOORS

The present invention relates to improved pet doors and more particularly to the sealing of pet doors.

As is known, in its simplest form a pet door has a frame surrounding and hingedly supporting a flap. Weatherproofing such doors has proved troublesome and indeed some commercial doors of this type are devoid of seals. The difficulty primarily arises when a door is designed to open in both directions, to cater for ingress and egress. One successful design, which is weatherproof, comprises an outer frame, an inner frame hinged within the outer frame, and a flap hinged within the inner frame. One set of seals weatherproofs gaps between the two frames and another set weatherproofs gaps between the flap and inner frame. The construction and assembly of this design is relatively straightforward. However, there is room for improvement. For example, tooling costs, material cost and labour could all be saved if the inner frame could be eliminated, and disassembly by the owner to replace seals or damaged parts could be improved.

The object of this invention has been to design weatherproofed pet doors consisting simply of outer frames and flaps and which, although easily openable by pets in either direction, are guarded against inadvertent opening, for instance by the wind.

According to the present invention, there is provided a pet door wherein a frame thereof hingedly supports an inset flap, undersized with respect to the frame, to swing open for passage of a pet through the pet door, and means is provided for weather sealing the gap between the flap and frame, the sealing means in part comprising two coacting magnetic members, one attached to the inner edge of the frame and confronting a portion of the flap edge and the other attached to the said flap edge portion, and wherein the magnetic members are arranged for relative movement in a direction across the gap respectively into and out of face-to-face sealing contact upon movement of the flap into its closed position and away therefrom.

Thanks to magnetic attraction between the contacting magnetic members when the flap is closed, a latching effect is obtained. The latching effect is strong enough to withstand normal winds but not so pronounced as to prevent a small pet like a cat from "nosing" the flap open.

The flap can be top-hinged. The coacting magnetic members can be located then along portions of the frame and flap edges opposite the hinge, or along two opposite sides of frame and flap extending away from the hinge.

Compliant, non-magnetic sealing strips seal parts of the gap not sealed by the magnetic members.

One of the coacting members could be non-magnetised, ferromagnetic material.

Preferably, however, the coacting magnetic members comprise plastics magnets. Such magnets are advantageous on several grounds. Firstly, they do not rust. Thus costly rust-proofing treatments, plating and ferritic stainless steels are avoided. Secondly, being non-metallic, there is no risk of cold burns in sub-zero temperatures should a pet's nose contact them. Thirdly, plastics magnet strips of numerous standard cross-sectional shapes can be acquired, and extrusion into non-standard shapes is feasible.

Conveniently, at least one of the magnetic members is loosely attached to the frame or the flap and is thereby able to give and move to and fro in the direction across the gap, and means can be provided to urge the said at least one of the magnetic members away from its companion. Provision for the relative movement across the gap ensures tight weather sealing when the flap is closed yet allows the flap to open without jamming. Alternatively or additionally to the loose attachment just mentioned, the flap could be movable within the frame so as to move its magnetic member(s) relative to the companion magnetic member on the frame. For example, in a top-hung arrangement, the hinge could be designed to yield to permit limited vertical movement of the flap. Thus, the flap could have hinge pins fast therewith, on which spring means in the hinge act to bias the flap upwardly. Alternatively, the hinge pins could embody eccentrics operable to lower or raise the flap as the latter moves into and out of its closed position. Vertical flap movements need only be of the order of several millimeters or less.

Pet doors embodying the invention can be of a variety of shapes including square or rectangular, trapeziform, D-shaped and triangular. As will be described, the present pet doors can even be circular, a shape hitherto considered impractical to seal satisfactorily. In a top-hinged trapeziform door, the magnetic members are advantageously arranged along the bottom and upstanding side edges of the flap and frame. A similarly-hinged triangular door will have an apex at the bottom of the door and the said members will extend upwardly therefrom along the adjacent edges which project upwardly. Similarly, in a top hung D-shaped door, the members will preferably extend around the arcuate edge section of the flap and frame, the said section being lowermost. The members may then be continued upwardly along the opposite side edges towards the hinge side.

A circular door according to the invention preferably has the magnetic members extending around a major part of the flap and of the frame. In one example of such a door, the magnetic member of the flap is loosely received in a seating groove in the flap, enabling it to move in and out to and fro in the direction across the groove, and a tension spring connects its ends and biases the magnetic member inwardly relative to its groove.

In another example, the flap has a plurality of magnetic members mounted thereon, and magnetic members located adjacent and one to either side of the hinge connection between the frame and flap are mounted on arms pivoted to the flap, whereby these magnetic members are displaceable on their arms relative to the companion magnetic member(s) of the frame. The drawback of such a design is careful balancing of the pivoted arms may be necessary.

Embodiments of the invention will now be described by way of example with reference to the accompanying drawings, in which.

Figure 7:
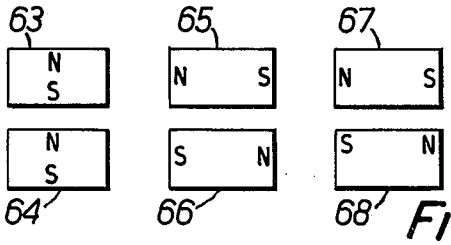
Figure 8:
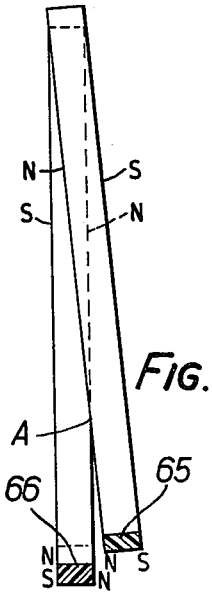

FIG. 7 diagrammatically illustrates exemplary patterns of magnetisation of magnetic members useable in the present invention, and FIG. 8 illustrates the magnetic members when a pet door incorporating them is just ajar.

Figure 1:
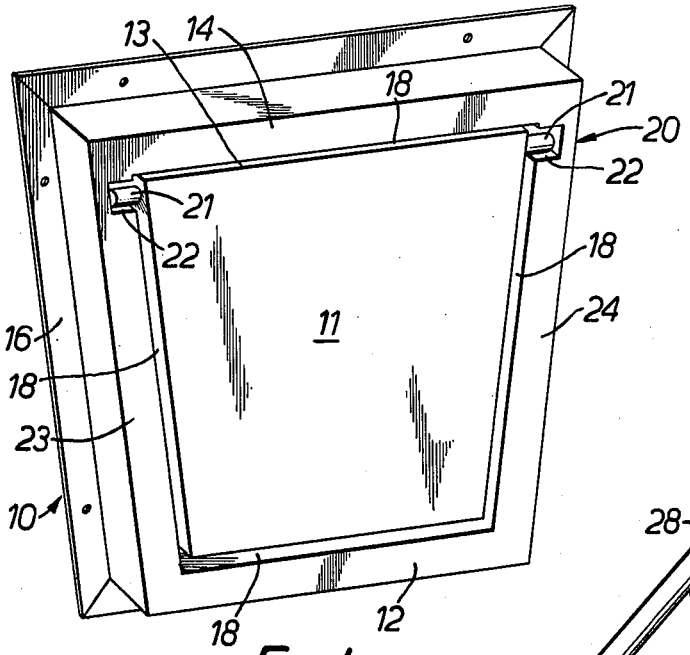
FIG. 1 is a perspective view of a first embodiment of the invention.

The first embodiment, shown in FIG. 1, is a trapeziform pet door 10 having a top-hung flap 11 in a frame 12. Both flap 11 and frame 12 taper downwardly, their greatest breadths being along their hinge sides 13, 14. A mounting flange 16 extends around the frame at a front side of the door 10. For mounting the door 10 on site, a hole in a house wall, door or window is first made, shaped and sized to pass the frame 12. The flange 16 is then screwed, bolted or otherwise secured to the wall, door or window. Other embodiments, to be described, are furnished with equivalent mounting flanges but these are not shown in FIGS. 2 to 6 for simplicity.

The flap 11 is undersized with respect to the opening therefor in the frame 12 and so there are gaps 18 between their confronting edges all around the flap. The flap 11 is free to swing open in both directions, allowing a pet to pass through the door 10 and enter or leave the house.

The hinge connection 20 between the flap and frame comprises hinge pins 21 fast with the flap rotatable in receivers 22 in opposite sides 23, 24 of the frame. The receivers 22 are shown for simplicity as pockets providing ledges on which the pins 21 bear. The receivers 22 can be closed by snap-in covers, not shown, to prevent the pins 21 slipping out and the flap being detached from the frame. Other hinge constructions, permitting easy mounting of the flap 11 and retention of the pins 21 in their receivers, will occur to designers. More elaborate hinge connections 20 will be described hereafter.

Sealing means are provided for weatherproofing the gaps 18 around the flap 11. In part, the sealing means illustrated later will comprise one, or more, pairs of coacting magnetic members, and in addition one or more non-magnetic, compliant seals. In the present embodiment, there can be just one pair of magnetic members. These will be mounted on confronting edges of the flap 11 and frame 12 to seal the gap along the bottom of the flap. Compliant seals will then weatherproof the gaps along at least the sides of the flap and the top, too, if the hinge connection with the frame is not of a weatherproof configuration. Two pairs of said magnetic members may seal the gaps along the lateral sides of the flap 11 instead. Then, compliant seals will weatherproof the gap along the bottom of the flap 11 and along the top, if necessary. If desired, magnetic members can be provided to seal the bottom and side gaps, the top gap being weatherproofed if the hinge configuration requires by a compliant seal. In this case, it is envisaged three separate pairs of magnetic members would be used, though it may be feasible to integrate them into one pair, particularly if the bottom corners of the flap 11 and frame 12 were rounded.

The magnetic members in this and the other embodiments comprise one plastics magnet strip and either a soft iron keeper strip or, preferably, a second plastics magnet strip. The preferred embodiments described herein employ pairs of plastics magnet strips. Such strips are commercially available, e.g. under the name FEROBA.

When the door 10 is closed, the magnetic members are attracted to each other and make face-to-face sealing contact. They also latch the door shut against the flap 11 being blown open. A stronger force on the flap 11 by a pet will, however, suffice to open the door 10. The door will not jam against opening or closing, since the or each pair of magnetic members are arranged for relative movement in a direction across the gap they seal. The relative movement is into and out of face-to-face sealing engagement upon movement of flap 11 into and out of its closed position. The necessary freedom for movement can be achieved by mounting one or other, or both, paired magnetic members loosely to the flap 11 or frame 12. The loose mounting can be accomplished by placing the magnetic member in an accommodating channel in e.g. the flap 11. The configurations of the magnetic members and their channels should be designed to obstruct draught as far as possible. Paths through which draught might by-pass the sealing means should, for instance, be labyrinthine. The drawings do not show ideal draught-excluding configurations for the sake of simplicity of illustration. Alternatively, or additionally, the hinge connection 20 can be arranged to allow or cause the flap 11 to rise and fall a few millimeters.

A square or rectangular door can be generally similar to the trapeziform door of FIG. 1. Its flap or the frame may, for instance, have a magnetic member or members on one, two or three sides loosely mounted for movement into sealing contact with the opposed magnetic member(s). Biasing spring means opposing the movement are provided to draw the movable member(s) away from the opposed magnetic member(s) whenever the flap is out of its door-closed position, to assure jam-free operation of the flap in the frame opening.

Figure 2:
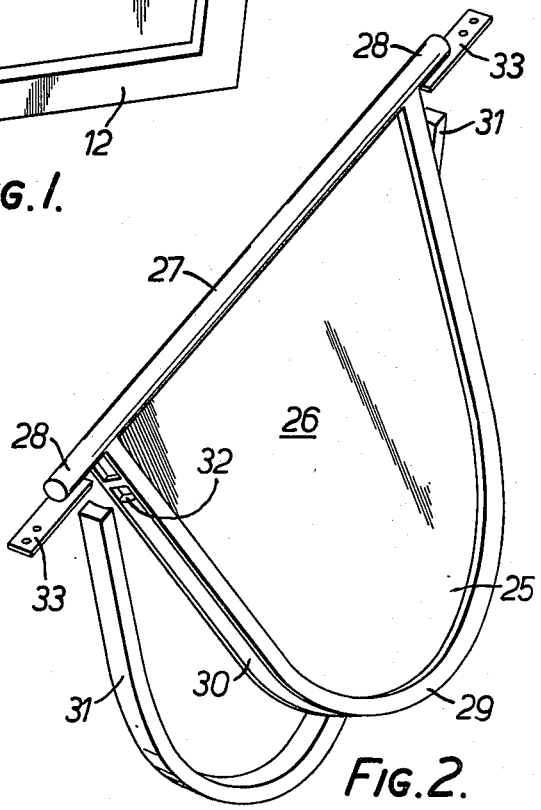
FIG. 2 is a simplified perspective view of a second embodiment of the invention, in a partially open state.
Figure 3:
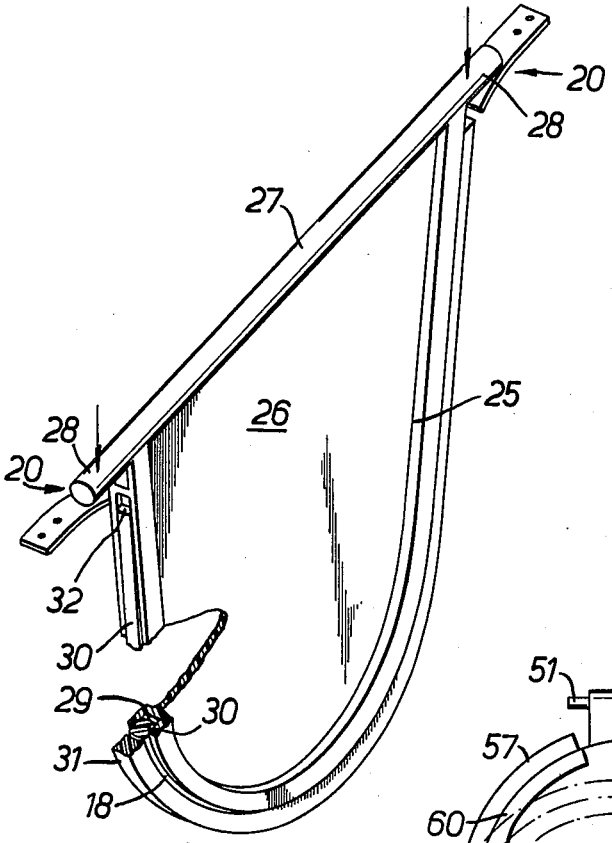
FIG. 3 is a view similar to FIG. 2 of the second embodiment in a closed state.

Turning now to FIGS. 2 and 3, a second embodiment will now be described. For simplicity, the flanged frame of this door is omitted from the illustrations. The frame will define an opening shaped to receive the undersized flap 25. Flap 25 will be top hinged. It is substantially D-shaped, straight across the top, arcuate around its bottom and with sides which diverge upwardly. The flap is a plastics moulding consisting of a panel portion 26, a spine 27 providing hinge pins 28 at its ends, and a peripheral channel 29 around its divergent sides and arcuate bottom. A plastics magnet strip 30 is seated in the channel 29. The seating is arranged in any convenient way to hold the magnet 30 from falling out, but the fit may be loose enough to allow the strip to move slightly lengthwise of the channel 29. Magnet 30 coacts with a second magnet strip 31 retained in a channel around the frame opening. Again, this magnet 31 could be free to move lengthwise slightly in its channel.

The loose mounting of one or other, or both, of the magnets 30, 31 accommodates inaccuracies of manufacture and allows the magnets to achieve full face-to-face contact throughout their lengths when the door is closed. If magnet 30 is free to move in channel 29, movement of magnet 30 across the gap 18 into contact with magnet 31 will be accompanied by the ends 32 of magnet 30 moving in the channel away from the spine 27. The magnets 30, 31 may to advantage be so magnetised that their opposite polarities are concentrated along their opposite front and rear faces (as the door is viewed facing the flap). In this case opening of the flap 25 will cause the magnets to repel one another. This has beneficial consequences coupled with the loose mounting of at least one of them to accommodate the lengthwise movement accompanying the relative movement across the gap caused by the repulsion. Close fitting of the frame and flap, and excellent draught proofing is obtained while jam-free closing and opening is guaranteed thanks to the repulsion. Spring means could act on the loosely mounted magnet(s) to bias it or them away from the other.

Further to assure jam-free operation, the hinge connection of the flap to the frame may optionally allow flap 25 to move vertically within the frame opening. Here, the hinge pin receivers in the frame incorporate weak leaf springs 33 on which the pins 28 rest. Springs 33 bias the flap 25 upwardly. When the door is open, the flap is held in a raised position by the springs 33, as in FIG. 2. Upon the flap entering its closed position, magnetic attraction between magnets 30, 31 exerts a downward pull on the flap. This causes the springs 33 to deflect or give and the flap drops no more than a few millimeters bringing the magnets 30, 31 into sealing contact. During opening, the above-noted repulsion and the springs 33 will urge the door flap 25 upwards in its opening.

Springs other than leaf springs could be substituted. Moreover, if the door frame is made of suitable plastics material, the hinge receivers could be designed to provide flexible webs on which the pins 28 bear. Such webs would be arranged to bias the flap upwards, and to yield permitting downward excursion of the flap 25 in response to mutual attraction between the magnets 30, 31.

Alternatively, the hinge connection could operate positively to cam the flap up and down during its opening and closing movements. For example, the pins 28 could run in vertical slots in the frame, and be fast with eccentrics riding on fixed abutments in the hinge receivers.

Vertical movability of the flap is not essential since the light weight, or low inertia, of the movably-mounted magnetic member(s) alone assures adequate weatherproofness and jam-free operation.

The first embodiment, shown in FIG. 1, can have its magnetic members mounted as described with reference to FIGS. 2 and 3. Moreover, hinge connection 20 of the first embodiment can be arranged to allow or cause vertical excursion of the flap, as just described.

Figure 4:
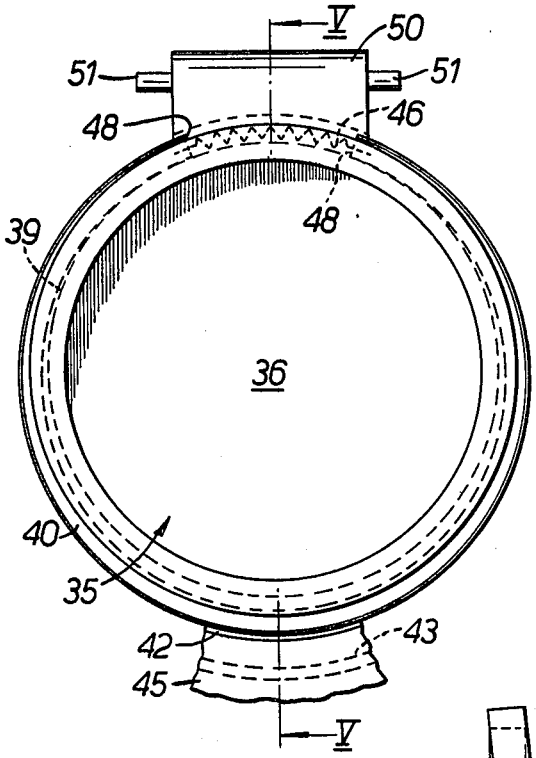
FIG. 4 is a simplified side elevation of a third embodiment of the invention which provides a circular port for passage of a pet therethrough.
Figure 5:
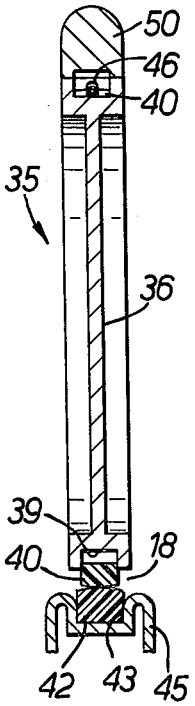
FIG. 5 is a vertical sectional view of the third embodiment on the line V—V of FIG. 4.

Cat doors embodying the invention can provide sealed, circular ports for passage of a pet. One example is shown in FIGS. 4 and 5. Here, the flap 35 comprises a circular panel 36 encircled by a channel 39 in which a plastics magnet 40 is retained. This magnet extends around a major part of the circumference of the flap 35, and coacts with a similarly-extensive plastics magnet 42 in a channel 43 around a circular opening of the frame 45. One of the magnets will normally be secured against movement in its channel, while the other is free to move circumferentially in its channel. As illustrated, magnet 40 is free to move in this way. Both magnets could so move, if wished. The magnet 40 here has its ends connected by a weak tension spring 46 which tends to draw the magnet ends 48 towards one another. This biasing urges the magnet 40 inwardly, away from the companion magnet 42, but allows magnet 40 to move outwardly across the gap 18 into sealing contact with the other magnet on closing. As the door flap moves away from its closed position and the magnetic attraction between the magnets weakens, the spring 46 contracts. This pulls the magnet 40 away from magnet 42 and deeper into the channel 39.

The flap 35 has an upstanding lug 50 and oppositely-projecting hinge pins 51 which engage in receivers in the frame 45. The hinge connection can be constructed so as to permit or cause vertical excursion of the flap 35, as described with reference to FIGS. 2 and 3.

Figure 6:
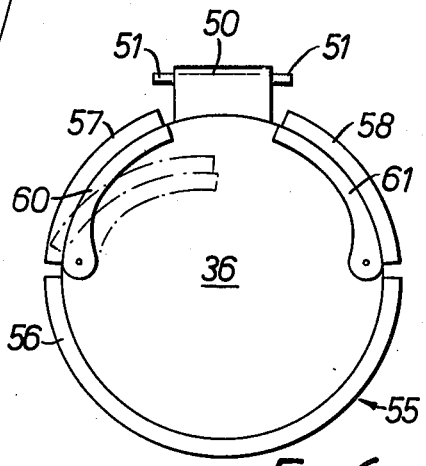
FIG. 6 is a simplified side elevation of a fourth embodiment of the invention, which again provides a circular port.

The flap 55 of a second pet door providing a circular entrace or exit port is shown in FIG. 6. This pet door can be constructed and arranged to operate in the same manner as the last-described embodiment except as indicated below. The same reference numerals as used above appear in FIG. 6 for equivalent parts.

In this embodiment the flap carries a plurality of magnets. These coact with one or more magnets on the door frame. One magnet 56 extends around the lower half of the flap 55, for instance captive in a channel, not shown. Magnet 56 can be a loose fit on the flap so as to be capable of moving radially in and out across the gap between the door flap 55 and frame. Two further magnets 57, 58 are provided on the flap in positions one to either side of the hinge connection of the assembled door. The magnets are fixedly mounted on arms 60, 61 individually pivoted at one end to the flap panel 36. With this arrangement, magnets 57, 58 can move inwardly on their pivoting arms 60, 61 as shown dotted, during opening of the flap, and in the opposite direction across the said gap upon closing. Thanks to this inward movement; troublefree opening is achieved. Movement of the arms can be influenced by appropriate balancing or by spring biassing.

In another circular door or port, the flap has a plurality, e.g. four, arcuate magnetic members mounted on its periphery for coacting with the sealing means of the frame opening. The latter sealing means can comprise a single magnetic member (c.f. member 42 of the FIG. 4 embodiment) or a plurality of arcuate members. The magnetic member(s) on flap and frame or one of them may move radially across the gap therebetween for instance against a weak spring bias as discussed with reference to the FIG. 4 embodiment. Thus, the arcuate members on the flap may be movable outwardly across the gap, against the counter biasing force, as the flap assumes its closed position.

The movable arcuate members could all be mounted on pivoted arms akin to the arrangement shown in FIG. 6.

The facing surfaces of the magnetic members could be plane transverse to their lengths. Preferably, one is convex and the other concave however. An example is shown in cross section in FIG. 3. This configuration ensures that in the door-closed state, the seal is light-proof, weatherproof and may be considered advantageous in icing conditions. Tests show that if the flap is iced up and broken open, a bead of ice will generally remain along one or other of the magnets. The illustrated configuration, probably coupled with the ability of at least one magnet to move relative to the gap, is well able to ride over such an ice bead when the flap is subsequently moved between open and closed positions. Doors having hinge connections which permit vertical excursion of their flaps are designed to cope well with severe icing conditions, also.

Plastics magnets can be magnetised in sereral ways, as schematically shown in FIG. 7 in end view. Companion flap and frame magnets 63, 64 can have their poles extend lengthwise, one on either side of the thickness of the strips. Obviously they will be applied to the flap and frame so that their confronting faces are of opposite polarities. Alternatively, the lengthwise-extending poles will be adjacent opposite faces considered widthwise of the strips, see the magnet pair 66, 67. These magnets will be mounted such that a north pole of the one on the flap is directly opposite a south pole of the other on the frame, in the door-closed state. A rather similar arrangement is shown for the magnet pair 67, 68 which is asymmetrically magnetised, the polar concentration being at adjacent corners of the strips.

Plastics magnets magnetised as shown at 63, 64 may be preferred in a door as shown in FIG. 1. Such magnets are especially suitable where the only magnets are along the bottom of the door. Some pets are known to be hesitant about leaving a house, and may often nose the door open slightly before deciding against leaving. Use of magnets magnetised as shown in 65, 66 or 67, 68 in this FIG. 1 arrangement could prevent a hesitantly-nudged flap from closing, owing to mutual repulsion. In normal use, of course, the speed of the swinging door will overcome the mutual repulsion. Magnets 63, 64 will not experience the mutual repulsion leading to a door remaining ajar.

For doors having the magnetic members extending upwardly towards the hinge, however, magnets as shown at 65, 66 or 67, 68 are preferred. FIG. 8 provides the key.

FIG. 8 shows the flap magnet 65 in relation to the frame magnet in a door-ajar condition of, for instance, the door shown in FIGS. 2 and 3. In this condition, the magnets will be mutually repelling at the bottom of the door owing to the adjacent like poles. From this one might expect the door has a tendency to adopt a stable partly-open setting. This will not happen however, because upwardly of the door bottom the magnets will be attracting one another strongly into registry. Above point A in FIG. 8 the mutual magnetic forces tend to close the door and they exceed the forces below point A which oppose closing. The net result is that if the door is hesitantly nudged ajar, the magnetic system will provide a self-closing action. Models show this action to be particularly effective. It will be appreciated that opening of the FIG. 8 arrangement will involve an element of repulsion initially along the bottom of the door. This repulsion occurs as the flap magnet 65 is moved out of its dotted line position in registry with the frame magnet 66. Thanks to the movable mounting of one or both magnets to its associated door member, smooth opening of the door is assured.

We claim:

1. A pet door comprising a frame, an inset flap received within said frame and being undersized with respect thereto, difining a gap therebetween, hinge means secured between a top portion of said flap and said frame permitting said flap to swing open for passage of a pet therethrough, and means for weather sealing said gap, said sealing means in part comprising two coacting magnetic members, one of said magnetic members being attached to an inner edge of said frame and confronting an edge of said flap and the other of said magnetic members being attached to said flap edge, at least one of said magnetic members being disposed for relative movement in a direction across said gap respectively into and out of face-to-face sealing contact with said other magnetic member upon movement of said flap into its closed positions and away therefrom, said hinge means being operable to lower said flap as it is moved into its closed position, whereby said magnetic member carried by said flap is moved into face-to-face contact with said other magnetic member.

2. A pet door according to claim 1, wherein said magnetic members extend along confronting portions of said frame and flap edges opposite to hinge means connecting said frame and flap.

3. A pet door according to claim 1, comprising two pairs of said magnetic members which extend away from hinge means connecting said frame and flap along two opposite sides of said frame and flap.

4. A pet door according to claim 1, wherein portions of said gap are sealed by the magnetic members and non-magnetic sealing strips close other portions of said gap.

5. A pet door according to claim 1, wherein one of said magnetic members is magnetised and the other is a non-magnetised ferromagnetic "keeper".

6. A pet door according to claim 1, wherein each magnetic member is a plastics magnet strip.

7. A pet door according to claim 6, wherein each magnetic strip has north polarity along one longitudinal edge and south polarity along its opposite longitudinal edge.

8. A pet door according to claim 1, wherein at least one of said magnetic members is loosely attached to its associated door component and is thereby able to give and move to and fro in the direction across said gap.

9. A pet door according to claim 8, wherein means is provided to urge said at least one magnetic member away from the other magnetic member.

10. A pet door according to claim 1, wherein said hinge means is operable to yield and allow said flap to be drawn downwardly, by magnetic interaction between said magnetic members, as the latter move into registry upon the flap moving into its closed position.

11. A pet door according to claim 10, wherein hinge pins of said hinge means are fast with the flap, and spring means act on the pins to bias said flap in an upward direction.

12. A pet door according to claim 1, wherein said flap and frame are of trapeziform shape and magnetic members of said sealing means extend along all sides but the hinging side.

13. A pet door according to claim 1, wherein said flap and frame are of D-shaped configuration hinged along the straight side, and magnetic members of said sealing means extend along the remaining confronting peripheries of said frame and flap, including arcuate sections thereof remote from said hinge means.

14. A pet door according to claim 1, wherein said frame defines a circular port, said flap is correspondingly circular, and magnetic members of said sealing means extend around a major part respectively of the peripheries of said frame and flap.

15. A pet door according to claim 14, wherein a plurality of magnetic members are mounted on said flap, and two arms pivoted to said flap, and located adjacent and one to either side of said hinge means connecting said frame and flap, mount two magnetic members on the flap, whereby each of these two magnetic members is displaceable on its arm relative to a companion magnetic member of the frame.

16. A pet door comprising a frame, said frame defining a circular port, an inset circular flap received within said port and being undersized with respect thereto, defining a gap therearound, hinge means secured between said frame and said flap permitting said flap to swing open for passage of a pet therethrough, said flap defining a groove around at least a majority of the periphery of same, and means for weather sealing said gap, said sealing means including two coacting magnetic members, one of said magnetic members being attached to an inner edge of said frame and extending around a major portion of same, and said other of said magnetic members being loosely received in said groove and extending around a major portion of the periphery of said flap, whereby said other of said magnetic members will move inwardly and outwardly with respect to said groove to and fro across said gap, opposite ends of said other magnetic member being secured to a tension spring which biases said member inwardly relative to said groove.

17. A pet door according to claim 16, wherein said tension spring is adjacent the hinge means connecting said frame and flap.

18. A pet door according to claim 16, wherein a plurality of arcuate magnetic members are mounted on said flap to move towards and away from the periphery thereof, each of said arcuate members being movable away from said periphery for making sealing contact with a coacting magnetic member of said frame.

19. A pet door comprising a frame, an inset flap received within said frame, said flap being undersized with respect to said frame, defining a gap therebetween, hinge means secured between a top portion of said flap and said frame whereby said flap may swing open for passage of a pet through said door, means for restoring said flap from a partially open to a closed position within said frame, said means for restoring means comprising first coacting magnetized members attached to an inner edge of a bottom of said frame and a bottom edge of said flap, and further coacting magnetized members attached to said frame and said flap along each of two opposed sides thereof, said further coacting magnetized members extending upwardly from said bottom edges towards a top of said frame and said flap, each of said further coacting magnetized members having north polarity along a longitudinal edge and south polarity along an opposite longitudinal edge thereof, said further coacting magnetized members being effective to overcome repulsive forces between said first magnetized members when said flap is partially open whereby said flap is biased toward its closed position.

* * * * *

UNITED STATES PATENT OFFICE

CERTIFICATE OF CORRECTION

Patent No. 4,480,407 Dated Nov. 6, 1984

Inventor(s) Robert J. Needham and Philip T. Blenkinsop

It is certified that error appears in the above-identified patent and that said Letters Patent are hereby corrected as shown below:

In the claims:

Claim 1, line 3, please change "difining" to read --defining--.

Signed and Sealed this

Second Day of April 1985

[SEAL]

Attest:

DONALD J. QUIGG

Attesting Officer

Acting Commissioner of Patents and Trademarks